US009481077B2

(12) United States Patent
Bodola et al.

(10) Patent No.: US 9,481,077 B2
(45) Date of Patent: Nov. 1, 2016

(54) TOOL STAND

(71) Applicants: Andreea Gabriela Bodola, Cluj (RO); Stefan Ionut Craciun, Bistrita-Nasaud (RO); Ionut Toparcean, Cluj (RO); Sorin Dan Mascas, Cluj (RO); Cosmin Valeriu Popa, Alba (RO)

(72) Inventors: Andreea Gabriela Bodola, Cluj (RO); Stefan Ionut Craciun, Bistrita-Nasaud (RO); Ionut Toparcean, Cluj (RO); Sorin Dan Mascas, Cluj (RO); Cosmin Valeriu Popa, Alba (RO)

(73) Assignee: Ridge Tool Company, Elyria, OH (US)

( * ) Notice: Subject to any disclaimer, the term of this patent is extended or adjusted under 35 U.S.C. 154(b) by 0 days.

(21) Appl. No.: 14/640,125

(22) Filed: Mar. 6, 2015

(65) Prior Publication Data

US 2015/0252937 A1 Sep. 10, 2015

Related U.S. Application Data

(60) Provisional application No. 61/950,273, filed on Mar. 10, 2014.

(51) Int. Cl.
*A47B 91/00* (2006.01)
*B25B 27/14* (2006.01)
*B25B 27/10* (2006.01)

(52) U.S. Cl.
CPC ..... *B25B 27/14* (2013.01); *B25B 27/10* (2013.01); *Y10T 29/49826* (2015.01); *Y10T 29/49959* (2015.01)

(58) Field of Classification Search
USPC ..... 248/346.04
See application file for complete search history.

(56) References Cited

U.S. PATENT DOCUMENTS 1,439,106 A * 12/1922 Ellwood ..... A47F 13/085 248/690
1,561,554 A * 11/1925 Little ..... F21V 21/0965 211/DIG. 1
3,285,135 A * 11/1966 Shaw ..... B27C 5/10 144/136.1
3,762,452 A * 10/1973 Bernald ..... B27C 5/10 144/136.95
4,339,942 A 7/1982 Svensson
4,373,240 A 2/1983 Castoe
4,985,817 A * 1/1991 Yale ..... F21L 14/02 248/206.5
5,156,463 A 10/1992 Zaguroli
5,160,114 A * 11/1992 Livingston ..... B23D 59/007 144/136.95
5,335,772 A * 8/1994 Chervenak ..... B65D 73/0014 206/349
5,367,924 A 11/1994 Henson et al.
5,695,165 A * 12/1997 Moriarty ..... B01L 9/54 248/205.4
5,979,215 A 11/1999 Lefavour et al.
6,119,317 A * 9/2000 Pfister ..... F16M 11/24 24/514
6,206,543 B1 * 3/2001 Henry ..... A45F 5/02 362/103
6,279,741 B1 * 8/2001 Arvin ..... B25H 3/006 206/349
6,619,101 B1 * 9/2003 Faucher ..... B25B 27/10 72/416
6,718,870 B1 * 4/2004 Frenken ..... B25B 27/10 100/102

(Continued)

OTHER PUBLICATIONS

International Search Report (ISR) and Written Opinion; PCT/US15/19109; Jun. 10, 2015; 9 pages.

(Continued)

*Primary Examiner* — Monica Millner
(74) *Attorney, Agent, or Firm* — Mark E. Bandy; Rankin, Hill & Clark LLP

(57) ABSTRACT

A selectively attachable tool stand is described. The stand can be attached to the head of a tool and enables the tool to be positioned on a work surface or the ground while maintaining a desired orientation for the tool head. The stand can also be removed or detached from the tool. The stand also supports the tool in an inclined orientation which can occur during use of the tool. The tool stand can be used with a variety of tools including manually operated crimp tools.

22 Claims, 6 Drawing Sheets

(56) References Cited

U.S. PATENT DOCUMENTS 6,755,597 B2 * 6/2004 Bergner ..... B23Q 7/10 144/136.95
6,837,373 B2 * 1/2005 Huang ..... A45F 5/021 206/376
6,892,717 B1 * 5/2005 Polanco ..... F41B 5/06 124/44.5
6,951,289 B2 * 10/2005 Scott, Jr. ..... A47B 81/005 211/64
7,024,792 B2 * 4/2006 Graham ..... G01B 3/1071 33/759
7,290,574 B2 11/2007 Baber
7,344,118 B2 3/2008 Samberg
7,410,333 B2 * 8/2008 Henzler ..... B23C 1/20 144/136.95
7,717,278 B2 * 5/2010 Kao ..... B25H 3/04 206/349
7,950,534 B2 * 5/2011 Kao ..... B25H 3/04 211/70.6
8,025,193 B1 * 9/2011 Gornall, Jr. ..... A45F 3/14 224/268
8,302,786 B2 * 11/2012 Kao ..... A47F 5/0846 211/70.6
8,403,278 B1 * 3/2013 Kasbohm ..... F41C 33/06 211/64
8,820,690 B2 * 9/2014 Weber ..... A42B 3/044 248/229.15
2001/0008246 A1 * 7/2001 Grover ..... A45F 5/02 224/247
2003/0044252 A1 * 3/2003 Landt ..... B25F 3/00 409/182
2003/0188566 A1 * 10/2003 Lefavour ..... B25B 27/10 72/453.16
2003/0223836 A1 * 12/2003 Pozgay ..... B23Q 9/0035 409/182
2003/0226946 A1 * 12/2003 Liao ..... B05B 15/061 248/316.7
2008/0087785 A1 * 4/2008 Roche ..... A47B 81/005 248/309.4
2009/0184070 A1 * 7/2009 Kao ..... B25H 3/04 211/70.6
2009/0218741 A1 * 9/2009 Winnard ..... B25H 3/06 269/8
2010/0032535 A1 * 2/2010 Elliott ..... B25H 3/006 248/229.22
2011/0197451 A1 * 8/2011 Mitchell ..... B23D 29/002 30/92

OTHER PUBLICATIONS

Adjustable Guitar Neck Rest. Duck's Deluxe; Aug. 24, 2013; https: web.archive.org/web/20130824024236/http://ducksdeluxe.com/gnrindex.html; 9 pages.

* cited by examiner

TOOL STAND

CROSS REFERENCES TO RELATED APPLICATION

This application claims priority upon U.S. Provisional Application Ser. No. 61/950,273 filed Mar. 10, 2014.

FIELD

The present subject matter relates to a stand for supporting a tool. Particularly, the present subject matter relates to a support stand that can be attached to a head portion of a tool such as a crimp tool.

BACKGROUND

Crimp tools are provided with various styles of crimp heads. One of the most popular is a C-frame head which allows easy access to crimping inserts, dies, or other tool components, due to its open face, as shown in FIG. 1.

To accommodate various positions and tool orientations while crimping, many C-frame heads can be rotated along the center axis of the tool, such as shown in FIG. 2. The narrow rear portion of the head and the ability of the head to rotate, increases the difficulty for an operator if he chooses to work with the C-frame head positioned on the ground or other surface.

Accordingly, a need exists for an assembly and/or method to promote ease of use of such tools, and particularly when such tools are used by placement on the ground or other surface.

SUMMARY

The difficulties and drawbacks associated with previously known tools are addressed in the present tool stands, systems of tool and stand, and methods of use.

In one aspect, the present subject matter provides a tool stand for supporting a head of a tool. The stand comprises a body including a first shoulder and a second shoulder spaced from the first shoulder. The body defines a recessed receiving region between the first shoulder and the second shoulder. The body also includes a first base member extending from the first shoulder and a second base member extending from the second shoulder. The body defines a first proximal face, a second oppositely directed distal face, a first lateral face extending between the first proximal face and the distal face, a second lateral face also extending between the first proximal face and the distal face, the second lateral face being generally oppositely directed from the first lateral face, and an underside extending along and between the first and second base members. The receiving region defined by the body is sized and shaped to receive a region of the head of the tool to be supported.

In another aspect, the present subject matter provides a tool system comprising a tool including a head and at least one of a frame and a handle. The head defines a rearwardly directed region. The tool system also comprises a stand having a body including a first shoulder and a second shoulder spaced from the first shoulder. The body defines a recessed receiving region between the first shoulder and the second shoulder. The body also includes a first base member extending from the first shoulder and a second base member extending from the second shoulder. The body defines a first proximal face, a second oppositely directed distal face, a first lateral face extending between the first proximal face and the distal face, a second lateral face also extending between the first proximal face and the distal face, the second lateral face being oppositely directed from the first lateral face, and an underside extending along and between the first and second base members. The receiving region defined by the body is sized and shaped to receive the rearwardly directed region of the head of the tool.

In yet another aspect, the present subject matter provides a method for supporting a tool that includes a head and at least one of a frame and a handle. The head defines a rearwardly directed region. The method comprises providing a tool stand having a body including a first shoulder and a second shoulder spaced from the first shoulder, the body defining a recessed receiving region between the first shoulder and the second shoulder, the body also including a first base member extending from the first shoulder and a second base member extending from the second shoulder, the body defining a first proximal face, a second oppositely directed distal face, a first lateral face extending between the first proximal face and the distal face, a second lateral face also extending between the first proximal face and the distal face, the second lateral face being generally oppositely directed from the first lateral face, and an underside extending along and between the first and second base members, wherein the receiving region defined by the body is sized and shaped to receive the rearwardly directed a region of the head of the tool. The method also comprises positioning the tool relative to the stand such that the rearwardly directed region of the head of the tool is disposed in the receiving region of the body of the stand.

As will be realized, the subject matter described herein is capable of other and different embodiments and its several details are capable of modifications in various respects, all without departing from the claimed subject matter. Accordingly, the drawings and description are to be regarded as illustrative and not restrictive.

DETAILED DESCRIPTION OF THE EMBODIMENTS

In many embodiments, the present subject matter provides an attachment stand for a C-frame type head of a wide array of tools, and particularly for manual crimp tools. The stand may include a releasable pin for affixing the stand to a tool. The stand can be easily attached to a tool and detached by one person. The stand is mounted or otherwise engaged with a tool along a rear portion of the tool's head and particularly a C-frame head. Upon positioning the stand and tool on the ground or other surface, the stand provides multiple points of contact with the ground. As a result of the location of the stand when engaged to the tool, an operator can lift the tool from an opposite end or its handles allowing the tool head and stand to pivot on an edge or side of the stand. To attach and detach the stand, an operator displaces an engagement pin typically by pressing, and rotation of the pin 180°, to unlock the pin. After rotation of the pin, the pin can then be removed from its receiving aperture in the tool head. A guide screw or other threaded member can be used to limit the movement of the pin. A compression spring or other biasing means can be used to urge the pin to a desired position relative to the aperture in the tool head.

Figure 1:
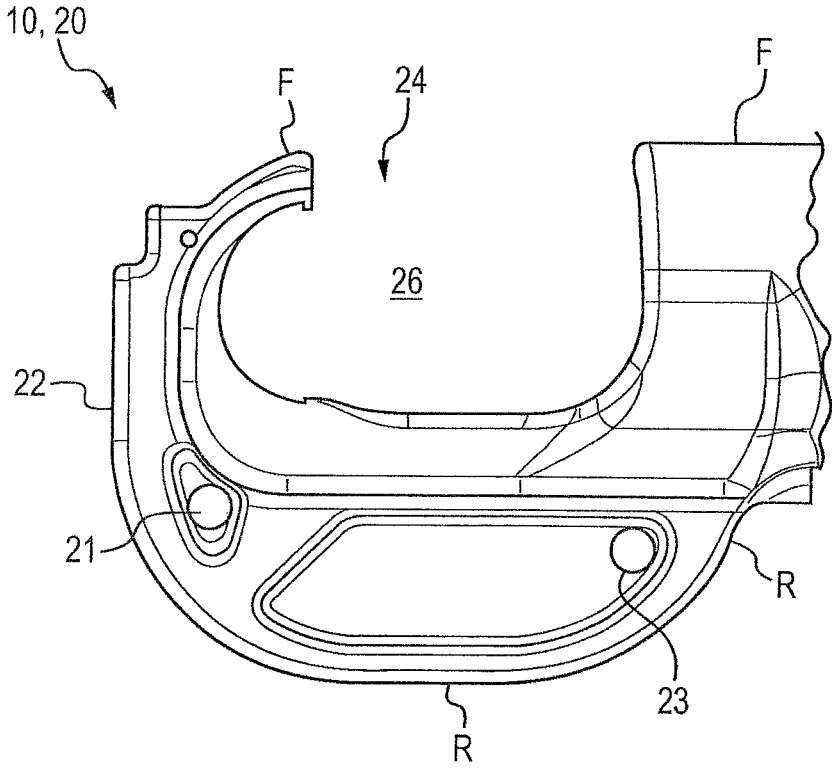
FIG. 1 is a side elevational view of a C-frame head used in various tools.
Figure 2:
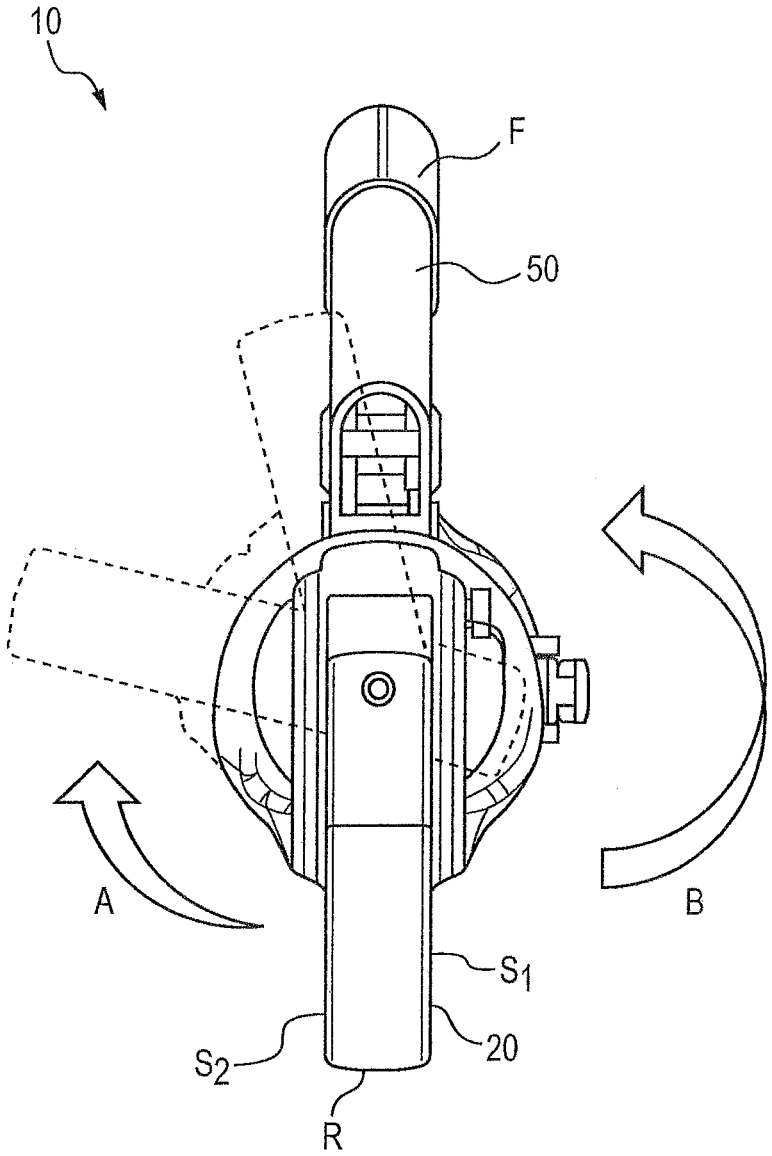
FIG. 2 is an end view of a crimp tool having a C-frame head, illustrating rotation between the head and the remaining portion of the tool.

More specifically, referring to FIGS. 1-5, a tool 10 such as a manually operated crimp tool is shown. The tool 10 comprises a C-frame head 20 defining a proximal head end 22, a first head aperture 21 and in certain embodiments a second head aperture 23. It will be understood that the C-frame head shown in FIG. 1 is merely representative of a typical C-frame head. The present subject matter is not limited to that particular head configuration. For example, the C-frame head may not include apertures 21 and/or 23. Or, if including one or more apertures, the apertures could be defined at different location(s) in the head. Typically, the aperture(s) extend entirely through the thickness of the head. However, in certain embodiments the aperture(s) do not extend completely through the head. The C-frame head 20 also defines an access region 24 which provides access to an interior working region 26 of the head 20. As will be understood, the working region 26 is the location at which one or more operations such as crimping are performed upon workpieces such as cables and/or lugs.

The tool 10 also comprises a frame 30, a primary handle 40 and depending upon the tool and its configuration, a secondary pump handle 50. In certain embodiments, the primary handle 40 can be an extension of the frame 30. As will be appreciated, typically the secondary handle 50 is pivotally attached at pivot 54 to one or both of the frame 30 and/or the primary handle 40. Movement of the secondary handle 50 in the direction of arrows C and D results in advancement of a ram or other component for performing operation(s) in the working region 26 of the head 20. Each of the handles 40 and 50, defines distal ends 42 and 52, respectively.

The following conventions are used herein. The front of the tool is shown as F. The rear of the tool is opposite the front, and shown as R. A first side and a second side are oppositely directed and shown as $S_1$ and $S_2$, respectively.

Figure 3:
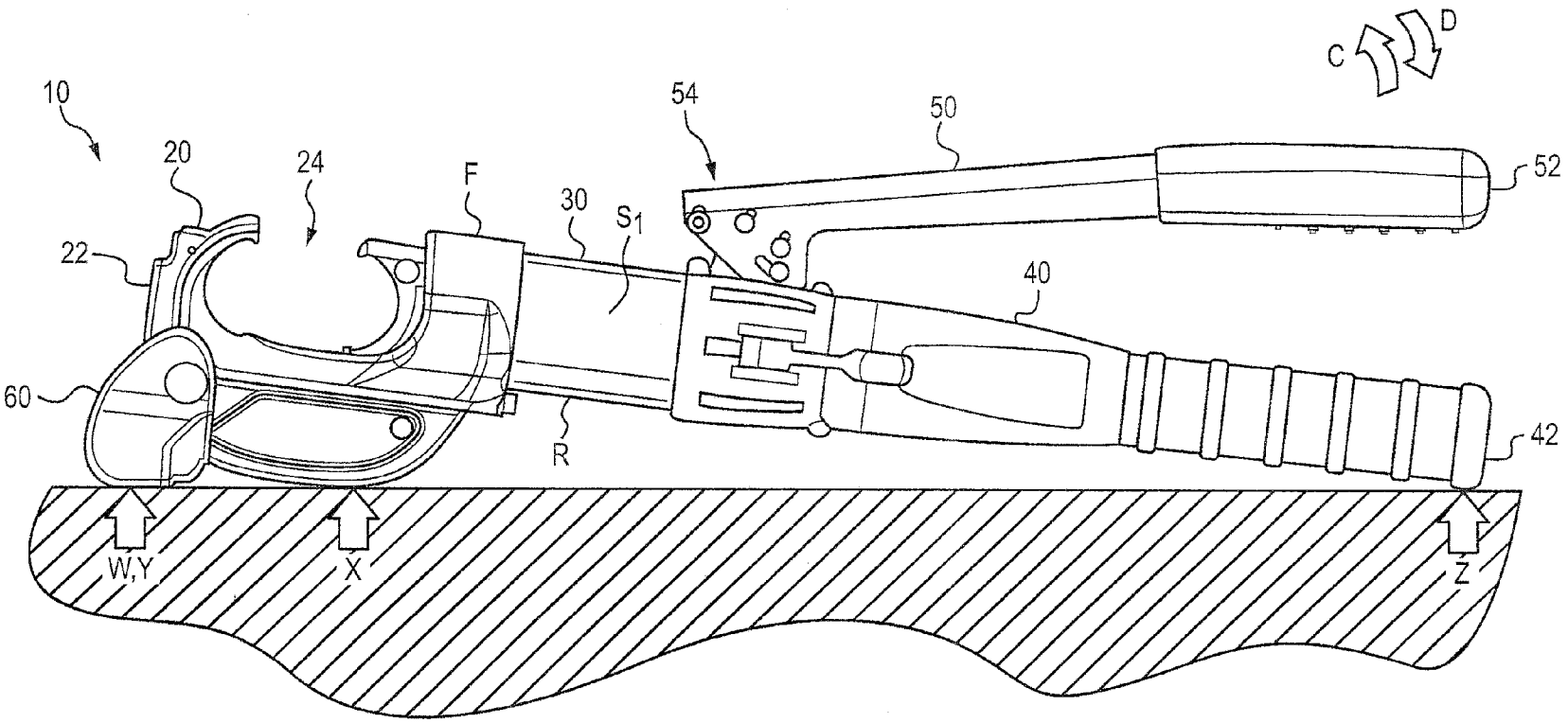
FIG. 3 is a side elevational schematic view of a tool stand engaged with a crimp tool and supporting the tool in accordance with the present subject matter.
Figure 4:
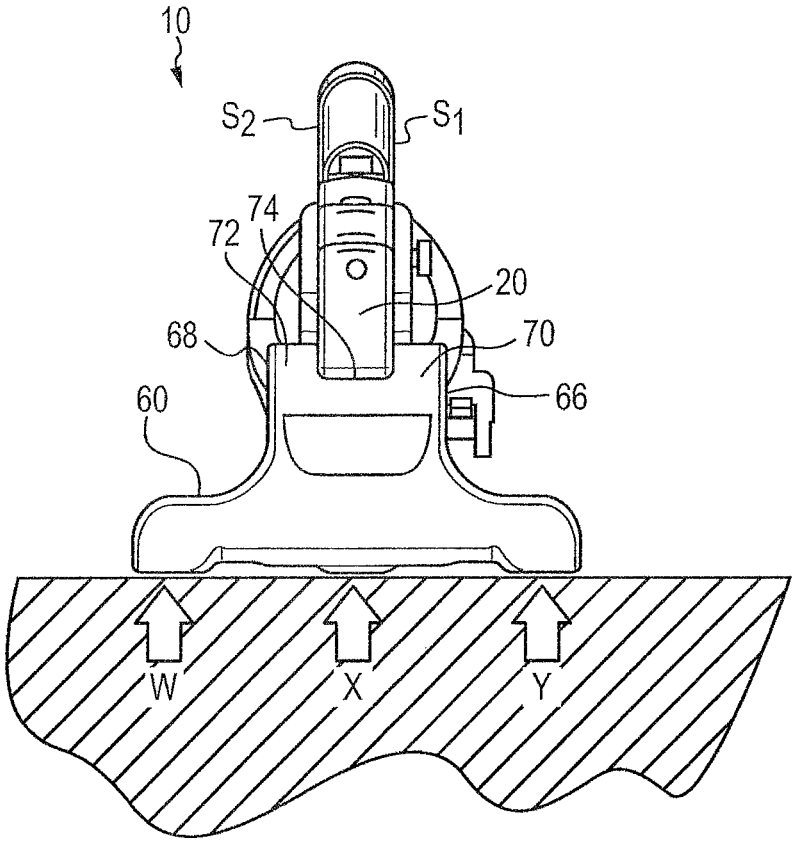
FIG. 4 is an end schematic view of the tool stand and crimp tool shown in FIG. 3.
Figure 5:
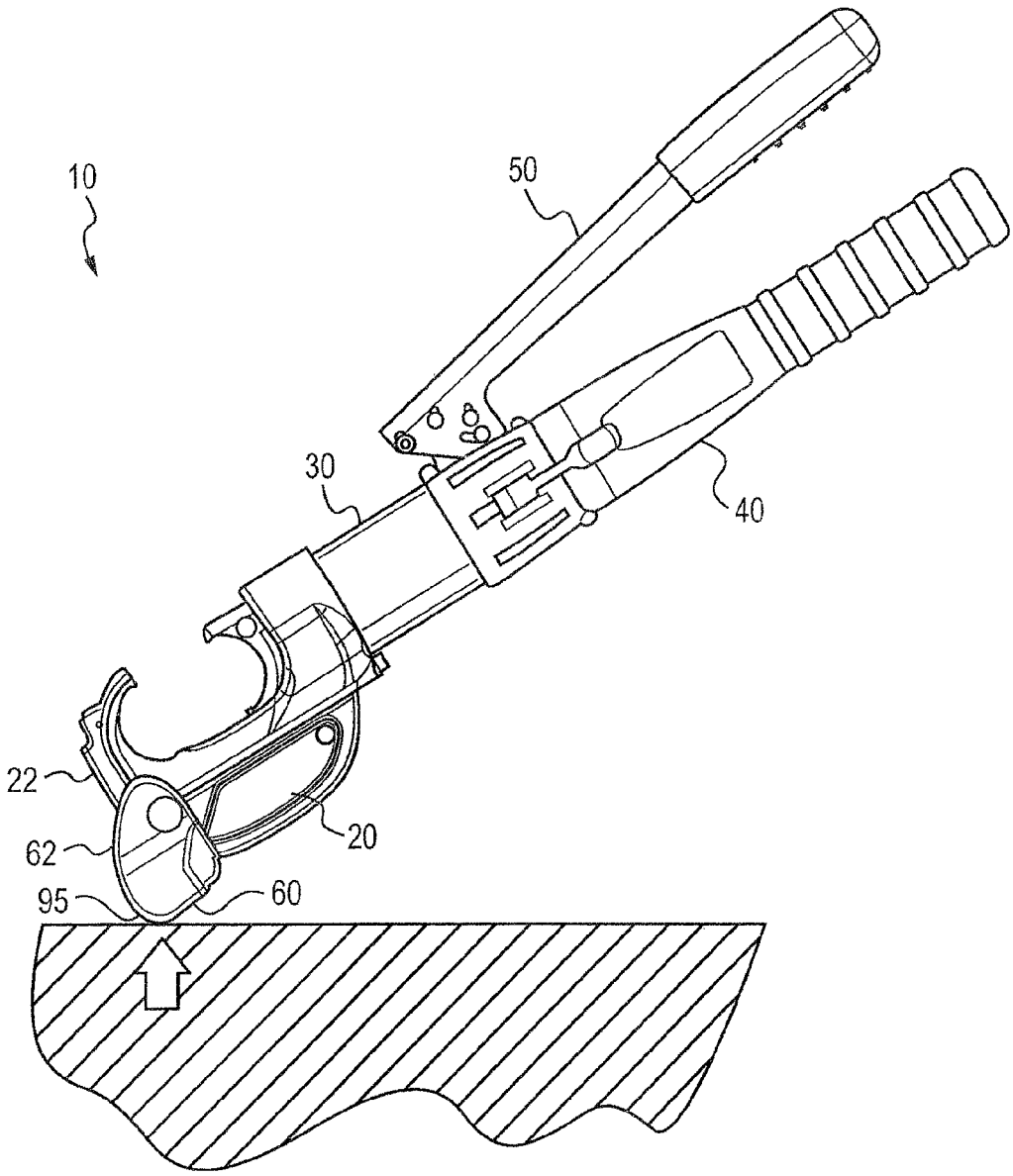
FIG. 5 is another side elevational schematic view of the tool stand and crimp tool in accordance with the present subject matter.
Figure 6:
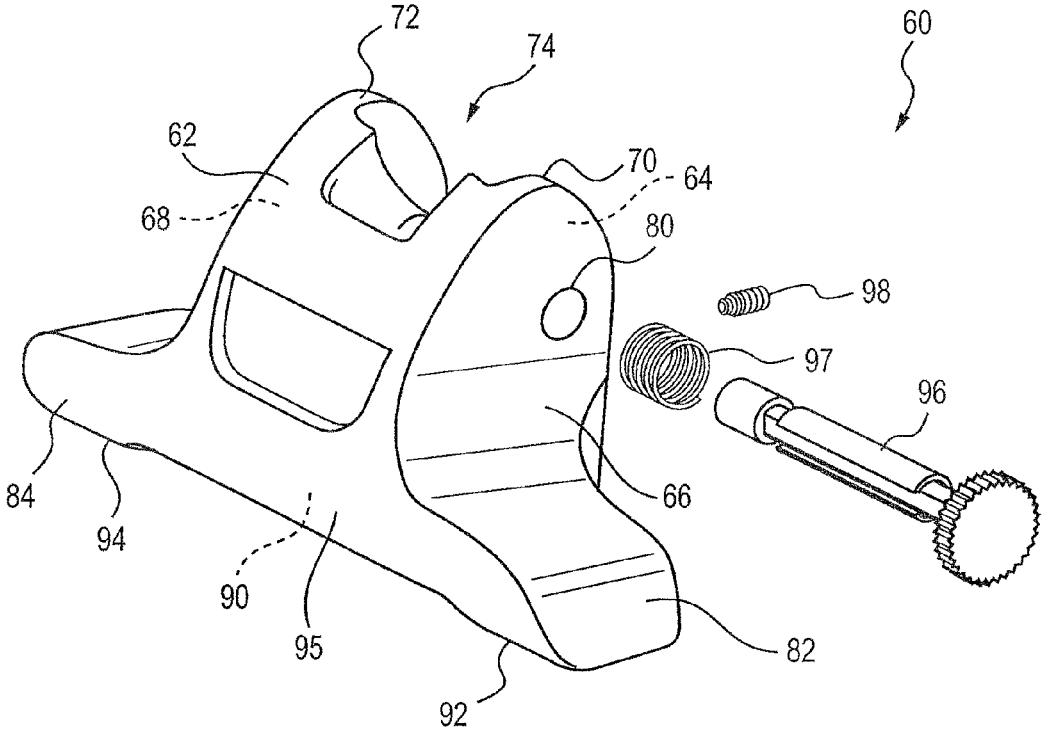
FIG. 6 is a detailed perspective view of the tool stand and components for releasably engaging the stand with a tool in accordance with the present subject matter.

An embodiment of the present subject matter stand is illustrated in FIGS. 3-6 as stand 60. In FIGS. 3-5, the stand 60 is shown engaged to the head 20 of the tool. In FIG. 6, the stand 60 is shown separate and detached. The stand 60 generally defines a body having a proximal face 62, and an oppositely directed distal face 64. The faces 62 and 64 are separated by a first lateral side 66 and second lateral side 68. The second lateral side 68 is generally oppositely directed from the first lateral side 66.

The stand 60 comprises a first shoulder 70 and a second shoulder 72 spaced from the first shoulder 70. The stand 60 also defines a recessed receiving region 74 generally extending between the shoulders 70, 72. The receiving region 74 is sized and shaped to receive a rear portion of a head of a tool to be supported such as for example the head 20 of the tool 10. In certain versions of the stand 60, the receiving region 74 is matingly configured to the contour of the rear portion of the head of the tool such as the head 20. The term "matingly configured" refers to the contour of the surface extending between the shoulders 70, 72 matching or substantially so, the contour of the rear portion of the head 20. This results in a relatively high degree of contact between the head 20 and the receiving region 74 of the stand 60.

In certain embodiments, the stand also defines an aperture 80 accessible along at least one of the first lateral side 66 and the second lateral side 68. In certain versions of the stand 60, the aperture 80 extends between both sides 66 and 68 and extends through both shoulders 70, 72. However, the present subject matter includes stands in which the aperture 80 extends into or through only one shoulder. It will also be understood that the present subject matter includes stands that do not include the aperture 80.

The stand also comprises a first base member 82 and a second base member 84 that typically extend laterally outward from each of the shoulders 70, 72. In certain versions of the stand such as stand 60, the first base member 82 extends laterally outward from a lower region of the first shoulder 70. And, the second base member 84 extends laterally outward from a lower region of the second shoulder 72.

The stand 60 also defines an underside 90. The underside is oppositely directed from the receiving region 74. In certain versions, a first contact face 92 is provided along the underside 90 of the first base member 82. And, a second contact face 94 is provided along the underside 90 of the second base member 84.

As previously noted, the stand 60 may also include one or more components such as an engagement pin or pin assembly 96, a biasing member such as a spring 97, and a guide screw 98 or other engagement member. The pin or pin assembly 96 is sized for insertion in the aperture 80.

The stand 60 is attached, affixed, or otherwise engaged with the tool 10 by positioning a rear region of the head 20 of the tool in the receiving region 74 of the stand 60. If the head 20 includes an aperture, the head 20 is positioned in the stand 60 such that one of the head apertures such as the first head aperture 21 is aligned with the aperture 80 defined in the stand 60. The pin 96 is then inserted into the aperture 80 of the stand 60 and the aperture 21 of the tool head 20. For versions of the stand 60 in which the aperture 80 extends through both shoulders 70, 72, the pin 96 is also extended therethrough. As previously noted, biasing means such as a spring 97 can be used to urge the pin 96 to a desired position relative to the stand 60. The guide screw 98 or other securing provisions can be used to secure the pin 96 within the aperture 80 of the stand 60.

Upon engagement of the stand 60 to the head 20 of the tool, the resulting assembly of tool and stand can be located on the ground or other surface in a relatively stable position with the access region 74 of the head directed upwards. In this position and as shown in FIGS. 3 and 4, the stand 60 contacts the ground at locations W and Y. Locations W and Y correspond to the portions of the underside 90 along the first contact face 92 and the second contact face 94, respectively. In this position as shown in FIGS. 3 and 4, at least one other point of contact occurs between the tool 10 and the ground, and typically two points of contact occur which are shown as locations X and Z in FIG. 3. It will be appreciated that depending upon the configuration of the tool, only one point of contact between the tool and ground may occur such as location X or Z. Alternatively, more than two points of contact between the tool and ground may occur.

In certain versions of the stand such as the stand 60, the stand defines a proximal edge 95 which extends along a lower region of the proximal face 62 of the stand 60, generally between the first and second base members 82 and 84. The edge 95 may be rounded or arcuate to provide a transition between the proximal face 62 and the underside 90. Upon orienting the assembly of the stand 60 and the tool 10 to an inclined position as shown in FIG. 5, contact between the stand 60 and the ground may occur along the entirety of, or at least along a portion of, the proximal edge 95. It is known that during many instances of use of tools such as tool 10, the head 20 is placed upon the ground while the distal end of the tool is lifted to facilitate pumping of the handle 50. In this orientation, use of the stand 60 improves stability of the assembly of tool and stand and resists lateral "tipping over" of the tool.

The present subject matter addresses difficulties related to the stability of tools such as manual hydraulic crimp tools, with a C-frame head during work performed with the tool positioned on the ground or other surface. The stand allows a single operator to position a cable and a cable lug or other workpieces inside the jaw of the tool while having one hand free to operate the pump and crimp the cable lug. Without the present subject matter stand, a second person usually assists in positioning and holding the tool stable.

The present subject matter provides both technical and commercial benefits. While the stand is attached to a tool, the tool can be easily displayed while supported on a shelf in a situation similar to if the tool were positioned on the ground such as depicted in FIG. 3. By balancing and holding the tool in a relatively straight position, the stand enables an operator to concentrate on positioning of workpieces such as a cable and lug. Without the present subject matter stand, a second person typically helps position and hold the tool stable.

Although the present subject matter is primarily described with regard to supporting the head of a crimp tool, it will be understood that the present subject matter is applicable to a variety of different types of tools and is not limited to crimp tools.

Many other benefits will no doubt become apparent from future application and development of this technology.

It will be understood that any one or more feature or component of one embodiment described herein can be combined with one or more other features or components of another embodiment. Thus, the present subject matter includes any and all combinations of components or features of the embodiments described herein.

As described hereinabove, the present subject matter solves many problems associated with previous strategies, systems and/or devices. However, it will be appreciated that various changes in the details, materials and arrangements of components, which have been herein described and illustrated in order to explain the nature of the present subject matter, may be made by those skilled in the art without departing from the principle and scope of the claimed subject matter, as expressed in the appended claims.

What is claimed is:

1. A tool stand for supporting a head of a tool, the stand comprising:

a body including a first shoulder and a second shoulder spaced from the first shoulder, the body defining a recessed receiving region between the first shoulder and the second shoulder, the body also including a first base member extending laterally from the first shoulder and a second base member extending laterally from the second shoulder, the body defining a first proximal face, a second oppositely directed distal face, a first lateral face extending between the first proximal face and the distal face, a second lateral face also extending between the first proximal face and the distal face, the second lateral face being generally oppositely directed from the first lateral face, and an underside extending along and between the first and second base members;

wherein the receiving region defined by the body is sized and shaped to receive a region of the head of the tool to be supported; and an aperture extending through at least one of the first shoulder and the second shoulder, the aperture accessible along at least one of the first lateral face and the second lateral face.

2. The tool stand of claim 1 wherein the receiving region of the stand is matingly configured to receive a region of the head of the tool.

3. The tool stand of claim 1 further including a first contact face along the underside of the first base member.

4. The tool stand of claim 3, further including a second contact face along the underside of the second base member.

5. The tool stand of claim 1, further comprising:

a pin sized for insertion in the aperture defined in the body of the tool stand.

6. The tool stand of claim 5 further comprising:

a coil spring coupled to the pin to urge the pin to a predetermined position relative to the aperture.

7. The tool stand of claim 6 further comprising:

an engagement member for affixing the pin at a predetermined position relative to the aperture.

8. A tool system comprising:

a tool including a head and at least one of a frame and a handle, the head defining a rearwardly directed region;

a stand having a body including a first shoulder and a second shoulder spaced from the first shoulder, the body defining a recessed receiving region between the first shoulder and the second shoulder, the body also including a first base member extending laterally from the first shoulder and a second base member extending laterally from the second shoulder, the body defining a first proximal face, a second oppositely directed distal face, a first lateral face extending between the first proximal face and the distal face, a second lateral face also extending between the first proximal face and the distal face, the second lateral face being oppositely directed from the first lateral face, and an underside extending along and between the first and second base members;

wherein the receiving region defined by the body is sized and shaped to receive the rearwardly directed region of the head of the tool; and an aperture extending through at least one of the first shoulder and the second shoulder, the aperture accessible along at least one of the first lateral face and the second lateral face.

9. The tool system of claim 8, wherein the head of the tool is a C-frame head and defines an access region that provides access to an interior working region.

10. The tool system of claim 8, wherein the tool also includes a secondary handle pivotally attached to at least one of the frame and the handle.

11. The tool system of claim 8 wherein the receiving region of the stand is matingly configured to receive a region of the head of the tool.

12. The tool system of claim 8, wherein the body of the stand further includes a first contact face along the underside of the first base member.

13. The tool system of claim 12 wherein the body of the stand further includes a second contact face along the underside of the second base member.

14. The tool system of claim 8, wherein the stand further comprises:

a pin sized for insertion in the aperture defined in the body of the tool stand.

15. The tool system of claim 14, wherein the stand further comprises:

a coil spring coupled to the pin to urge the pin to a predetermined position relative to the aperture.

16. The tool system of claim 15, wherein the stand further comprises:

an engagement member for affixing the pin at a predetermined position relative to the aperture.

17. A method for supporting a tool that includes a head and at least one of a frame and a handle, and the head defining a rearwardly directed region, the method comprising:

providing a tool stand having a body including a first shoulder and a second shoulder spaced from the first shoulder, the body defining a recessed receiving region between the first shoulder and the second shoulder, the body also including a first base member extending laterally from the first shoulder and a second base member extending laterally from the second shoulder, the body defining a first proximal face, a second oppositely directed distal face, a first lateral face extending between the first proximal face and the distal face, a second lateral face also extending between the first proximal face and the distal face, the second lateral face being generally oppositely directed from the first lateral face, and an underside extending along and between the first and second base members, wherein the receiving region defined by the body is sized and shaped to receive the rearwardly directed a region of the head of the tool;

positioning the tool relative to the stand such that the rearwardly directed region of the head of the tool is disposed in the receiving region of the body of the stand, wherein the body of the stand further defines an aperture extending through at least one of the first shoulder and the second shoulder, the aperture accessible along at least one of the first lateral face and the second lateral face, and the method further comprises: providing a pin sized for insertion in the aperture; inserting the pin into the aperture to thereby affix the stand and the tool together.

18. The tool system of claim 14, wherein the head of the tool defines a head aperture and upon the body of the stand receiving the head of the tool, the head aperture is aligned with the aperture extending through at least one of the first shoulder and the second shoulder.

19. The tool system of claim 18 wherein the pin is inserted in the head aperture and the aperture extending through at least one of the first shoulder and the second shoulder.

20. The tool system of claim 8 wherein the receiving region defined by the body is matingly configured to match the contour of the rearwardly directed region of the head of the tool.

21. The tool system of claim 8, wherein the stand further has a proximal edge extending along a lower region of the proximal face and between the proximal face and the underside, wherein the proximal edge is rounded or arcuate to provide a transition between the proximal face and the underside.

22. The tool system of claim 1, wherein the stand further has a proximal edge extending along a lower region of the proximal face and between the proximal face and the underside, wherein the proximal edge is rounded or arcuate to provide a transition between the proximal face and the underside.

* * * * *